United States Patent [19]

Kidd et al.

[11] 4,023,132

[45] May 10, 1977

[54] ELECTRICAL CIRCUIT BREAKERS

[75] Inventors: Alan Lister Kidd, Southport; Douglas Eaves, Blackpool; Keith Walmsley, Preston, all of England

[73] Assignee: Dorman Smith Switchgear Limited, Preston, England

[22] Filed: Dec. 8, 1975

[21] Appl. No.: 638,705

Related U.S. Application Data

[63] Continuation-in-part of Ser. No. 505,223, Sept. 12, 1974, Pat. No. 3,943,477.

[30] Foreign Application Priority Data

Oct. 4, 1973 United Kingdom ..... 46290/73

[52] U.S. Cl. ..... 337/82; 335/176; 337/57

[51] Int. Cl.[2] ..... H01H 73/22

[58] Field of Search ..... 337/6, 7, 45, 57, 82, 337/93, 94, 99, 2, 347, 360, 361, 368; 335/42, 45, 176; 74/553, 560; 200/336; 310/17

[56] References Cited

UNITED STATES PATENTS

| | | | |
|---|---|---|---|
| 3,084,236 | 4/1963 | Klein et al. | 335/10 |
| 3,142,187 | 7/1964 | Kane et al. | 74/553 |
| 3,211,861 | 10/1965 | Freese | 337/82 |
| 3,226,510 | 12/1965 | Thomas et al. | 337/57 |
| 3,317,764 | 5/1967 | Dremel | 310/17 |
| 3,708,771 | 1/1973 | Schreckenberg et al. | 337/82 |
| 3,775,713 | 11/1973 | Walker et al. | 335/176 |

*Primary Examiner*—Harold Broome
*Attorney, Agent, or Firm*—Ross, Ross & Flavin

[57] ABSTRACT

An electric circuit breaker or overload protection apparatus includes a thermal element which, on being heated by a fault current, is deflected to initiate a circuit-breaking tripping of the apparatus. A supporting mechanism for varying the rating of the apparatus includes an adjusting member or slide displaceable relative to the thermal element so as to vary the action of the thermal element, a recessed manually-operable externally-accessible knob, and a rotatable boss eccentrically and adjustably mounted in the knob recess and operative upon knob rotation to cause a variance in the displacement of the adjusting member and thus a variance in the rating of the apparatus.

2 Claims, 12 Drawing Figures

ELECTRICAL CIRCUIT BREAKERS

This invention is a continuation-in-part of application Ser. No. 505,223 filed by me on September 12, 1974, now U.S. Pat. No. 3,943,477 of Mar. 9, 1976.

The invention concerns electrical circuit breakers of the type wherein a thermal element, which upon occurrence of a sustained overload, that is, a sustained passage of current in excess of the rated capacity, initiates the tripping operation of the circuit breaker.

The invention provides a simple arrangement for varying the position of an adjusting member associated with the thermal element to enable the action of the latter to be varied and thereby to vary the rating of the circuit breaker.

The adjusting member includes a slide displaceable linearly by an eccentric boss rotatable manually by means of a knob accessible externally of the circuit breaker.

Conveniently, the knob is formed with a recess in which the boss is mounted.

Preferably, the position of the boss relative to the knob is adjustable to provide for a variation of the eccentricity of the boss so and thus the extent of the adjustment achievable by rotating the knob.

The boss and knob are conveniently formed, one with a groove and the other with a complementary rib engageable in the groove, the rib and groove extending diametrically relative to the axis of rotation of the knob and providing for corresponding diametrical adjustment of the boss.

In one preferred embodiment, the slide is engaged with the boss by the latter being located between confronting bearing surfaces at opposite sides of a recess in the slide.

Figure 2:
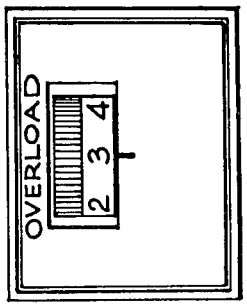
FIG. 2 is a view taken as indicated by arrow II of FIG. 1 and illustrating manually-operable adjustment means forming part of the FIG. 1 mechanism.

The tripping mechanism of a three-pole circuit breaker comprises, for each pole (the poles being indicated generally at A, B and C respectively), a thermal element in the form of a bimetal strip 10 secured in heat-conducting contact to a respective conductor 11 by which current passes through the corresponding pole of the circuit breaker. Each such bimetal strip 10 has a respective nose or protuberance 12 projecting toward a respective contact point provided by a respective calibration screw 13 on a trip bar 14.

Trip bar 14 extends across and is common to poles A, B and C, and is mounted so as to be pivotable about an axis extending longitudinally thereof. A clockwise pivoting of trip bar 14 from the FIG. 3 position results in circuit breaker tripping.

Accordingly, the construction of the trip mechanism is such that, upon the passage of a sustained overload through one of poles A, B or C, the corresponding conductor 11 becomes heated and transmits heat to the bimetal strip which, in due time, becomes deflcted towards trip bar 14 to cause this pivoting movement of the latter and the tripping of the circuit breaker.

The illustrated embodiment differs from prior known constructions in that it includes means (a) enabling the action of the thermal element to be varied and, additionally, (b) enabling the possible extent of such variation to be adjusted.

Figure 1:
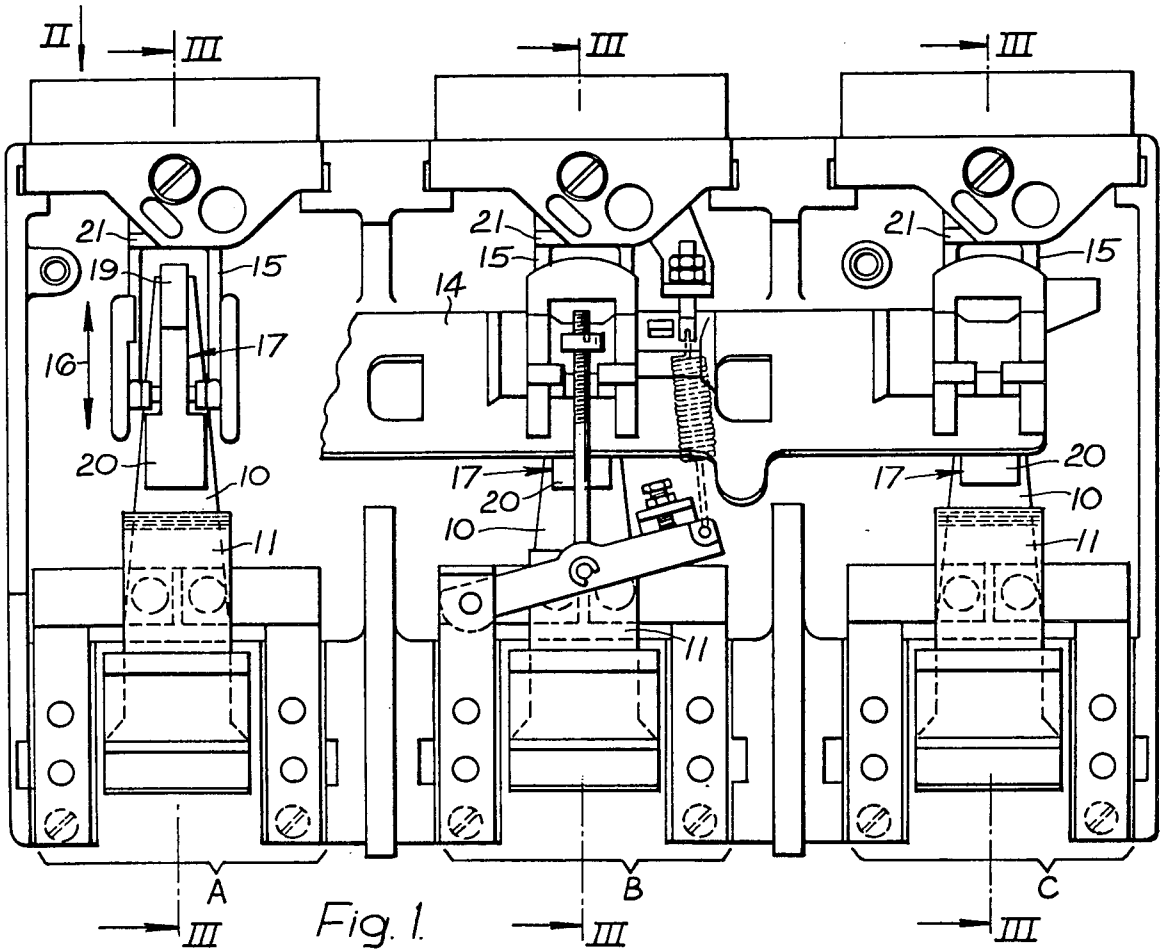
FIG. 1 is a view in elevation, with certain parts omitted or broken away for clarity, of the tripping mechanism of a three-pole circuit breaker.

Pursuant thereto, each pole A, B and C comprises a respective slide 15 which is displaceable in a plane parallel to the plane of respective bimetal strip 10, as indicated by the double arrow 16 in FIG. 1, and whereon a wedge member 17 is pivotally mounted by way of a pivot pin 18. Wedge member 17 has a wedge-shaped head 19 which projects between the respective nose or protuberance 12 and the corresponding calibration screw 13. It will be understood that the amount by which bimetal strip 10 needs to deflect to cause tripping movement of trip bar 14 varies according to the effective thickness of head 19 present between protuberance 12 and screw 13 as determined by the position of slide 15.

To minimise the possibility of wedge member 17 being affected by vibrations or shock, it mounts a counterweight 20 which substantially balances head 19.

Figure 3:
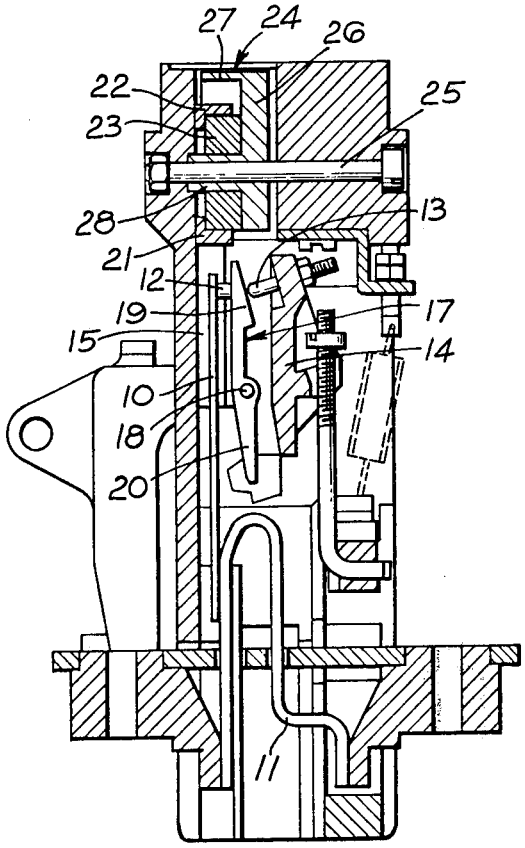
FIG. 3 is a section through the tripping mechanism in correspondence with any one of the poles of the circuit breaker as indicated by the section lines III—III of FIG. 1.

Slide 15 is formed, at its end away from wedge member 17, with a pair of transverse thrust ribs 21, 22 (see particularly FIG. 3). Located between these two ribs 21, 22 is a respective adjusting boss 23 secured eccentrically in a recess in a knob 24, which knob is pivotally mounted on a fixed pivot bolt 25 and is accessible from outside the casing of the circuit breaker.

It will be appreciated that rotation of knob 24, by reason of the eccentricity of boss 23, is translated into corresponding linear displacement of slide 15 along an axis substantially parallel to the axis of bimetal strip 10, as indicated by arrow 16.

Figure 7:
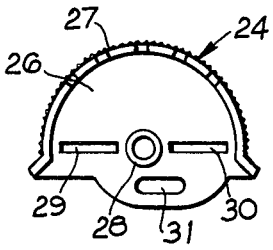
FIG. 7 is an elevation of the knob.
Figure 9:
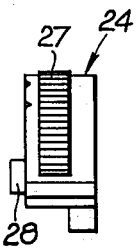
FIG. 9 is a side view of the knob.
Figure 8:
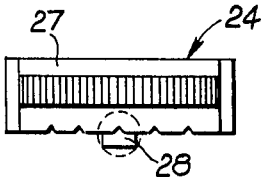
FIG. 8 is a plan view of the knob.

Knob 24 is illustrated in detail in FIGS. 7, 8 and 9 wherein it will be seen that it comprises an approximately semi-circular back plate 26 having therearound a flange 27 which defines the recess in which boss 23 is accommodated. An integral bush 28 is provided for pivot bolt 25 to extend therethrough. Extending diametrically at opposite sides of such bush 28 are shallow grooves 29 and 30. Parallel to grooves 29 and 30 is a slot 31.

Figure 10:
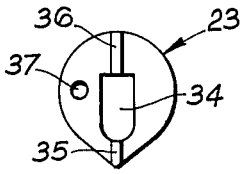
FIG. 10 is a front elevation of the boss.
Figure 11:
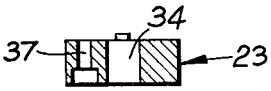
FIG. 11 is a cross-sectional view of the boss.
Figure 12:
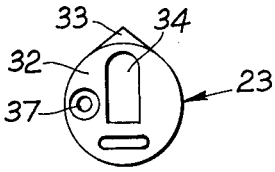
FIG. 12 is a rear elevation of the boss.

Boss 23 is shown in detail in FIGS. 10, 11 and 12 wherein it will be seen to be approximately pear-shaped in configuration. It is composed of a basic circular disc 32 formed with an approxiamtely triangular lobe 33, of a thickness somewhat thinner than the disc 32, at one point on its periphery, so that the configuration of boss 23 is symmetrical about an axis of symmetry extending substantially diametrically of disc 32 and through the top of lobe 33. A slot 34 is provided through boss 23 for slideably locating boss 23 over bush 28, this slot 34 being directed along the axis of symmetry. Also formed on this axis are two locating ribs 35 and 36 which are complementary to and engageable in grooves 29 and 30 in back plate 26 of knob 24.

Figure 4:
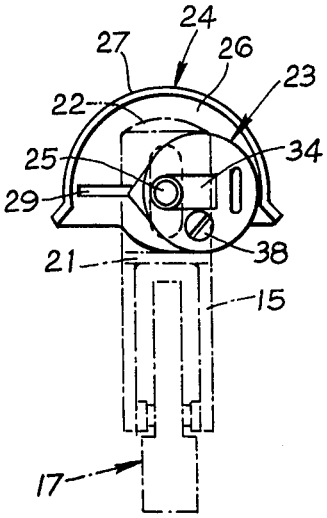
FIG.4 is a detached detail illustrating the eccentric boss and knob of the adjusting means of the FIGS. 1–3 arrangement, these components being shown in a mean position in which the boss can be adjusted relative to the knob without affecting the other components of the mechanism.
Figure 5:
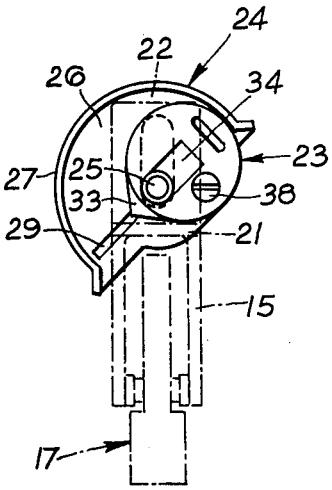
FIG. 5 is a view similar to FIG. 4 but showing the knob and boss having been adjusted to provide a minimum rating for the breaker.
Figure 6:
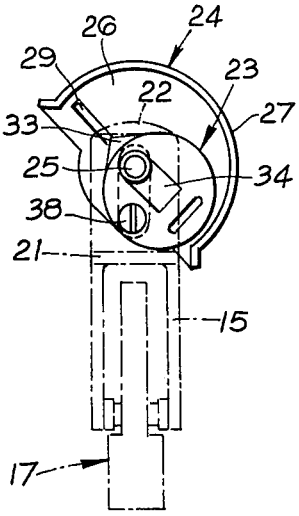
FIG. 6 is a view similar to FIGS. 4 and 5, but showing the knob and boss having been adjusted to provide a maximum rating for the breaker.

A counter bored hole 37 is provided through boss 23 adjacent slot 34 for permitting boss 23 to be fixed to the knob, as shown in FIGS. 4, 5 and 6, with ribs 35, 36 engaged in grooves 29, 30 and bush 28 accommodated in slot 34, by a bolt 38 through hole 37 and slot 31 in knob 24.

FIGS. 4, 5 and 6 show boss 23 secured to knob 24 in its position of maximum eccentricity so that rotation of knob 24 to the end position, shown in FIG. 5, in which lobe 33 abuts thrust rib 21, shifts wedge member 17 to its position with the thickest portion of head 19 between nose 12 and calibration screw 13, thereby adjusting the corresponding circuit breaker's pole to its lowest possible rating.

Conversely, rotation of knob 24 to the end position of FIG. 6, in which lobe 33 abuts thrust rib 22, shifts wedge member 17 to its position with the thrust portion of head 19 between nose 12 and calibration screw 13, thereby adjusting the corresponding circuit breaker's pole to its highest possible rating.

In the illustrated embodiment, with boss 23 at maximum eccentricity as shown, rotation of knob 24 provides for a variation of plus or minus about 20% from the designed rating which is obtained in the median position of knob 24 as shown in FIG. 4 in which the axis of symmetry of boss 23 is substantially perpendicular to the direction of movement of slide 15.

The magnitude of the possible variation of the rating achieved by adjusting the eccentricity of boss 23. This is done with knob 24 in its median position of FIG. 4 and is effected by slackening bolt 38, shifting boss 23, as required, along its line of symmetry and at right angles to the direction of movement 16 of slide 15 and retightening bolt 38. Since boss 23 is adjusted parallel to thrust ribs 21 and 22, the adjustment does not cause an alteration of the position of slide 15 and wedge member 17 and the median position and rating of the circuit breaker remains unaffected.

The degree of eccentricity of the boss is variable from zero to maximum so as to enable the range of rating adjustment to be varied likewise. Thus, it is possible to build a breaker having no adjustment (for a particular application) or using the same parts, a breaker having up to say - 30% rating adjustment.

The adjustable eccentricity of the boss being between the knob actuating surface and the means of varying the thermal element action, enables a fixed common scale of adjustment cooperating with the knob externally to be provided. This scale does not require individual calibration for different ratings.

The invention is not confined to the precise details of the foregoing example, and variations may be made thereto. Thus, although in the described embodiment, slide 15 carries wedge member 17 whose displacement serves to alter the action of bimetal strip 10, other arrangements are possible.

Thus, for instance, the slide could be arranged to displace bimetal strip 19 bodily towards or away from trip bar 14 or its corresponding calibration screw to alter the action of the bimetal strip and vary the effective rating of the circuit breaker. Furthermore, although it has been described with reference to a three-pole circuit breaker construction, it will naturally be understood that the invention can be applied to single-pole breakers.

We claim:

1. In an electric overload protection apparatus including a thermal element which on being heated by a fault current is deflected to enduce a pivotal movement of a trip bar and thus a circuit-breaking tripping of the apparatus, the improvement in means for varying the apparatus rating comrpising:

a slide displaceable relative to the thermal element to vary the amount by which said thermal element must deflect to cause said tripping, a recessed manually-operable knob supported for rotative movement relative to the slide, and an adjustable boss mounted eccentrically relative to the knob and in the recess thereof with rotation of the knob effecting displacement of the slide.

2. In an electric overload protection apparatus including a thermal element which on being heated by a sustained overload is deflected to effect a pivotal movement of a trip bar for causing circuit-breaking tripping of the apparatus the improvement in means for varying the apparatus rating comprising:

a slide pivotally mounting a wedge projecting between the thermal element and trip bar, a recessed manually-operable knob supported for rotative movement relative to the slide, and an adjustable boss mounted eccentrically relative to the knob and in the recess thereof with rotation of the knob effecting a linear displacement of the slide along a plane parallel and relative to the plane of the thermal element, the extent of deflection of the thermal element for achieving tripping of the trip bar being variable according to the effective disposition of the wedge between the thermal element and trip bar.

* * * * *